United States Patent [19]

Hall

[11] 4,425,107

[45] Jan. 10, 1984

[54] ROTATABLE DISPENSING WHEEL

[75] Inventor: Floyd V. Hall, Durham, N.C.

[73] Assignee: Liggett Group Inc., Montvale, N.J.

[21] Appl. No.: 285,784

[22] Filed: Jul. 22, 1981

[51] Int. Cl.[3] ..... A24C 5/50

[52] U.S. Cl. ..... 493/48; 222/218; 493/47

[58] Field of Search ..... 493/48, 47; 222/218, 222/217, 225, 368

[56] References Cited

U.S. PATENT DOCUMENTS

| | | | |
|---|---|---|---|
| 3,259,029 | 7/1966 | Hall et al. | 493/47 X |
| 3,446,404 | 5/1969 | Mehta | 222/225 |
| 3,656,518 | 4/1972 | Aronson | 222/218 X |
| 4,191,309 | 3/1980 | Alley et al. | 222/217 X |
| 4,214,508 | 7/1980 | Washington | 493/48 |

FOREIGN PATENT DOCUMENTS

| | | | |
|---|---|---|---|
| 1106931 | 3/1968 | United Kingdom | 493/48 |

*Primary Examiner*—James F. Coan

*Attorney, Agent, or Firm*—Kenyon & Kenyon

[57] ABSTRACT

The charcoal wheel is provided with pnuematic means for forcing the pistons outwardly to dispense charcoal and a second pneumatic means for the retraction of the pistons. The pneumatic ejection of the pistons permits a high speed output, for example 6000 inserts per minute i.e. more than twice the output of current state of the art machines. Each piston is made in one piece with an integral stop to limit the outward movement and the inward movement of the piston.

21 Claims, 3 Drawing Figures

10
11
12
13
14
15
16
17
18
19
20
21
22
23
24
25
26
27
28
29
30
31
32
33
34
35
36
40
41
42
43
44
45
46
47
48
F
A

ROTATABLE DISPENSING WHEEL

This invention relates to a rotatable dispensing wheel. More particularly, this invention relates to a charcoal dispensing wheel.

As is known, machines for making filter tips for cigarettes have employed rotatable wheels known as charcoal wheels for depositing charges of charcoal between spaced apart plugs of fibrous filter elements which are conveyed on a web of paper along a conveyor. For example, U.S. Pat. No. 3,259,029 describes a machine which employs a charcoal wheel in which a plurality of radially disposed holes are provided in the peripheral rim to receive and subsequently eject individual charges of charcoal. In order to eject the charcoal charges, the wheel has a plurality of plungers slidably mounted in the holes and a reciprocable hammer for pushing the pistons, individually or in pairs, outwardly in order to expel the charges of charcoal from the holes into the spaces between the moving filter elements.

Generally, charcoal wheels of this type are limited in speed, for example to a speed of approximately 2700 inserts per minute. In this respect, an insert is a charge of charcoal which is placed between two filter elements being conveyed under the wheel. Further, because of the hammering action, these charcoal wheels have not only been relatively noisy but also are subject to vibrations which, over a period of time, increase the need for maintenance of the wheel as well as the making of the machine. The increase in maintenance, in turn, increases the downtime of the machine and, thus, decreases the output of the machine.

Accordingly, it is an object of this invention to provide a charcoal wheel which is capable of relatively high speed operation.

It is another object of the invention to increase the speed of a cigarette filter making machine.

It is another object of the invention to provide a charcoal wheel which is able to operate with reduced noise.

It is another object of the invention to provide a dispensing wheel for granular material which is able to operate at a high speed in a simple manner.

Briefly, the invention provides a rotatable wheel having a plurality of peripheral chambers for receiving granular material and a plurality of pistons slidably mounted in the respective chambers for movement between a retracted position and an expelled position with pneumatic means for pneumatically moving the pistons sequentially outwardly from the retracted position to the expelled position at a dispensing station and means for returning each piston to a retracted position downstream of the dispensing station.

By using a pneumatic means for moving the pistons outwardly, the hammering effect which is otherwise produced by mechanical hammers within a wheel is eliminated. In addition, since the pistons are moved pneumatically, forces which are generated, for example by reciprocation of a hammer, no longer occur in the wheel. Further, the speed of the machine can be increased since there is no time needed to return a hammer to a retracted position before the next ejection.

In accordance with the invention, each piston has an integral stop for limiting outward movement.

The means for returning the pistons to the retracted position may also be a pneumatic means. In this case, this pneumatic means is located on the outside of the wheel so as to direct an air flow into the wheel.

The wheel may also have a cam for retaining the pistons in a retracted position after the pistons have been pneumatically returned to a retracted position.

The rotatable wheel also has a shroud which extends over the chambers in the wheel from a filling station at which charges of granular material are fed into the chambers to a dispensing station at which the charges are dispensed. The shroud has a slightly blunted tip in the filling station in order to push filter material aside while shearing particles of filter material which extend outwardly of a chamber passing under the tip of the shroud.

These and other objects and advantages of the invention will become more apparent from the following detailed description taken in conjunction with the accompanying drawings wherein.

Figures 1, 2:
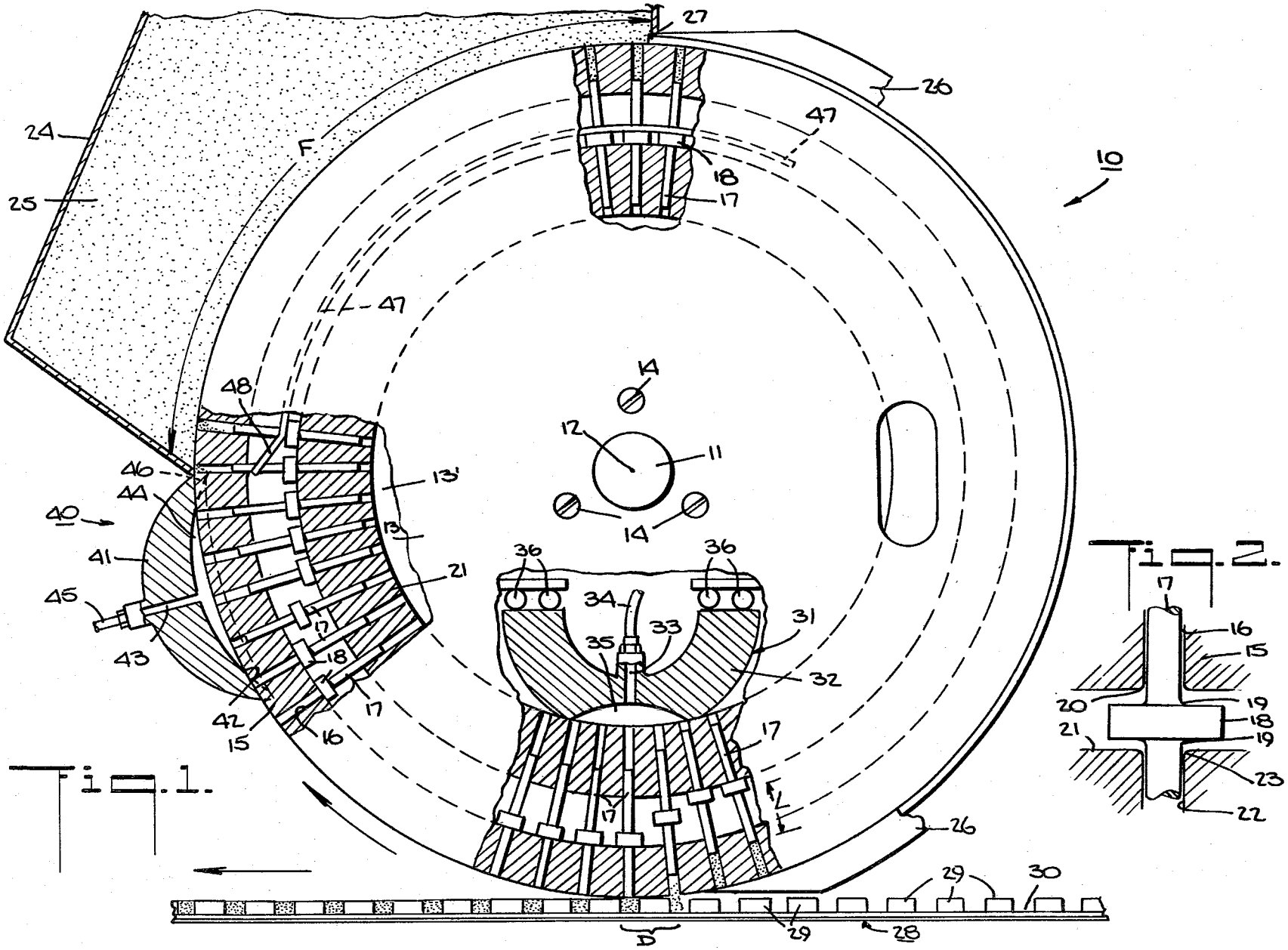
FIG. 1 illustrates a front view of a charcoal wheel constructed in accordance with the invention.
FIG. 2 illustrates an enlarged detail view of a piston within the wheel of FIG. 1.

Referring to FIG. 1, the charcoal wheel 10 of a filter making machine is mounted on a shaft or axle 11 for rotation about a fixed horizontal axis 12. The wheel 10 is constructed, for example of two circular plates 13, 13' which are secured together via bolts 14. In addition, an outer ring 15 is secured in a suitable manner between the plates 13, 13' to form the outer periphery of the wheel 10. This ring 15 is provided with a plurality of circumferentially disposed and radially directed chambers 16, for example, of circular cross-section, which extend completely through the ring 15.

In addition, the charcoal wheel 10 has a plurality of pistons or pins 17 slidably mounted in the respective chambers 16. As shown in FIG. 2, each piston 17 is of circular shape to slide in mating relation within a chamber 16 and has an integral stop 18 at an intermediate point for limiting radial movement of the piston 17 outwardly of the ring 15. Each piston 17 is formed of one piece, for example of tool steel having a 54-55 Rockwell Hardness on the C-scale so as to take stress without breaking. As shown, a circumferential fillet 19, 19' is provided between the piston 17 and the stop 18 on each side to further strengthen the piston 17 against shearing of the stop 18. Further, the outer ring 15 is provided with a circumferential notch or shoulder 20 about one end of the chamber 16 to matingly receive the fillet 19.

The piston 17 is sized so that the portion extending outwardly of the stop 18 is of a length L equal to the length of the chamber 16 i.e. the thickness of the ring 15. In this way, when the piston 17 is moved to an expelled position, the stop 18 abuts the ring 15 while the face of the piston 17 is substantially coplanar with the surface of the ring 15.

The wheel 10 also has a two-piece guide ring 21 secured between the plates 13, 13' concentrically within the outer ring 15 with a plurality of circumferentially spaced radially directed bores 22 of circular cross-sectional shape for slidably guiding an inner portion of the pistons 17. The inner portion of each piston 17 is of a length less than the length of a bore 22, i.e. the thickness of the guide ring 21 so that a small compartment remains in the bore 22 behind each piston 17 when the piston 17 is fully retracted. As shown in FIG. 2, each bore 22 of the guide ring 21 has a circumferential notch or shoulder 23 about one end to matingly receive a fillet 19' of the piston 17.

Figure 3:
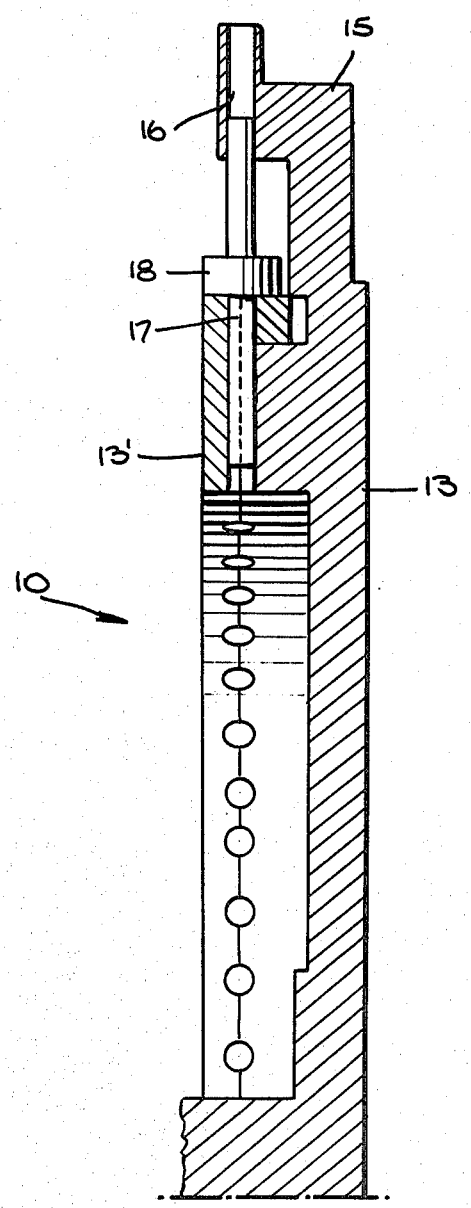
FIG. 3 illustrates a part cross-sectional view of the mounting of a piston in the charcoal wheel in accordance with the invention.

Referring to FIG. 3, the guide ring 21 is made in two annular pieces 21*a*, 21*b*, with one piece 21*b* being of larger diameter with an interrupted collar-like flange 49 to fit concentrically around the other piece 21*a* and thus provide for alignment of the two pieces. The two pieces are also formed with mating semi-circular recesses 57 which define the bores 22 for the pistons 17. In order to fit the pistons 17 in place, the guide ring pieces are separated, the pistons 17 laid in place and the pieces put back together such that one piece 21*a* fits within the other piece 21*b*. The circular plates 13, 13' are thereafter bolted together to hold the pieces in place.

The wheel 10 cooperates with a hopper 24 at a filling station F located above an upper quadrant of the wheel 10. This hopper 24 is filled with a granular filter material, such as charcoal 25, and is open at the bottom to deliver the charcoal under gravity into the chambers 16 of the outer ring 15 of the wheel 10. As indicated, the hopper 24 extends from a point at about a 9 o'clock position as viewed to slightly beyond the 12 o'clock position. Charcoal may begin to flow into the chambers 16 under gravity at the 9 o'clock position, however, most of the charcoal enters the chambers 16 from a position from about 10:30 on.

The charcoal wheel 10 also cooperates with a shroud 26 which is spaced about the periphery of the wheel 10 to insure that the charges of charcoal 25 which are deposited in the chambers 16 are retained during rotation of the wheel 10 to a dispensing station D below the wheel 10. This shroud 26 has a slightly blunted tip 27 at the forward end within the filling station F in order to push charcoal aside and to shear off any particles of charcoal extending upwardly out of the chambers 16.

Referring to FIG. 1, a conveyor 28 is located below the wheel 10 at the dispensing station D for conveying a series of spaced apart fibrous filter elements 29 on a traveling web of paper 30. The speed of the conveyor 28 and wheel 10 are synchronized so that each charcoal charged chamber 16 of the wheel 10 is aligned with a gap between two filter elements 29 in the dispensing station D. As indicated in FIG. 1, the shroud 26 terminates at a point at which a gap between two filters elements 29 is in alignment with a filled chamber 16. In this regard, the charcoal 26 can be forced by a piston 17 directly into the vertically aligned gap therebelow.

Referring to FIG. 1, in order to dispense the charges of charcoal, the wheel 10 uses a pneumatic means 31 for pneumatically moving the pistons 17 sequentially and radially an outward direction at the dispensing station D. As shown, the pneumatic means 31 includes a shoe 32 of generally semi-circular shape which is spring loaded against the inside cylindrical surface of the guide ring 21 and has a complimentary curved surface in surface-to-surface contact with the guide ring 21. In this respect, the guide ring 21 is made of steel while the shoe 32 is made of case-hardened carbon steel so as to be self-lubricating with respect to the guide ring 21.

The shoe 32 is provided with an internal passageway 33 which connects via a suitable conduit or air hose 34 to a source of pressurized air, for example at 10 to 40 pounds per square inch (psi). In addition, a peripheral cavity 35 is provided in communication with the passageway 33 and in aligned relation with the guide ring 21 so as to extend over a plurality, e.g. five, bores 22. The cavity 35 begins in a radial plane where the shroud 26 terminates.

Any suitable means 36, such as springs, are provided for resiliently biasing the shoe 32 against the guide ring 21. These springs 36 can be adjusted via mounting screws (not shown) to permit an adjustment of the shoe 32 on the guide ring 21.

A second pneumatic means 40 is also located between the dispensing station D and the filling station F for pneumatically moving the pistons 17 sequentially in an inward direction to abut a respective stop 18 thereon against the guide ring 21. This pneumatic means 40 includes a shoe 41 which has an arcuate surface 42 conforming to the outer circumference of the wheel 10 as well as an internal passageway 43 and an exterior cavity 44 which is aligned with the outer ring 15 and is of a length to extend over a plurality of chambers 16, for example five in the outer ring 15. The passageway 43 is connected via a suitable conduit or flexible hose 45 to a source of pressurized air (not shown) for example at 10 to 40 psi. In addition, the shoe 41 which may also be spring loaded against the wheel 10 has a pair of lateral flanges 46 which are disposed in overlapping relation with the periphery of the wheel 10 so as to confine the air blown out of the shoe 41 to the chambers 16.

The wheel 10 also has a cam 47 between the plates 13, 13' for retaining the pistons 17 in the retracted position. This cam 47 extends from a point slightly downstream from the pneumatic shoe 41 to a point beyond the filling station F. As indicated, the forward end 48 of the cam 47 has a shaped surface to insure that the pistons 17 are returned to the fully retracted position and retained in this position during travel through the filling station F. As also indicated, the cam 47 extends to a point under the shroud 26 to insure that the pistons 17 are retained in the retracted position until the chambers 17 have been filled.

In operation, as the charcoal wheel rotates 10, the empty chambers 16 of the outer ring 15 within the filling station F are filled with charcoal from the hopper 24 under gravity. During this time, the pistons 17 are retained in a retracted state by the cam 47. Continued rotation of the wheel 10 brings the filled chambers 16 under the shroud 26 and thence around to the dispensing station D. Upon moving over the terminal end of the shroud 26, each charcoal chamber 16 moves into the dispensing station D under the cavity 35 in the pneumatic shoe 32 and is brought under the influence of the air pressure in the cavity 35. The piston 17 is then driven outwardly and instantly by the air pressure within the cavity 35 so that the charcoal in the chamber 16 is expelled rapidly downwardly into the gap between two spaced apart filter elements 29. While still under the influence of pressurized air, the piston 17 arrives at a fully expelled position with the integral stop 18 thereof abutted against the inner peripheral surface of the outer ring 15.

Continued rotation of the wheel 10 brings the chambers 16 and expelled pistons 17 under the influence of the outer pneumatic shoe 41. During travel past this shoe 41, the pistons 17 are driven inwardly by the air pressure until the integral stops 18 abut the inner guide ring 21. Should the air supply to the shoe 41 be cut off, the entire machine is programmed to stop. In this case, the forward end of the cam 48 moves the pistons 17 to the fully retracted position while the wheel 10 comes to a stop to prevent shearing of the pistons 17.

After passing the shoe 41, the wheel 10 carries the now opened chambers 16 in the outer ring 15 under the hopper 24 to again fill with charcoal.

The chambers 16 in the outer guide ring 15 are sized to receive a charge of charcoal which is sufficient to fill completely a gap between two filter elements 29. For example, each chamber 16 is of a diameter of five millimeters with a length of fifteen millimeters and has a filling length (as shown at the top of FIG. 1) of ten millimeters. Likewise, each piston 17 has a diameter of five millimeters to slide within the chamber 16.

The charcoal wheel 10 can be operated at an output speed sufficient to produce 6000 inserts per minute for a wheel having a diameter of 1200 inches.

It is to be noted that various modifications may be made within the charcoal wheel 10. For example, the circumferential spacing of the pistons 17 may be varied to adapt to the spacing of the gaps between the filter elements conveyed on the conveyor 28 of the filter tip making machine. Further, the chamber and piston cross-sections may be varied, for example each chamber 16 and piston 17 may be elliptical or oval in cross-sectional shape.

The invention thus provides a charcoal wheel of simple construction which is capable of high speed operation. In this respect, the wheel operates without delay as soon as a charcoal chamber enters the dispensing station since there is no need for a time delay to retract a hammer or the like as in the past. Further, the wheel operates with a minimum of vibration so that the downtime for making adjustments or repairs in the charcoal wheel can be reduced to a minimum thereby increasing the efficiency of the wheel.

What is claimed is:

1. A rotatable wheel having a plurality of peripheral chambers for receiving granular material, a plurality of pistons slidably mounted in respective chambers for movement between a retracted position to permit filling of each said chamber with granular material and an expelled position to eject the granular material from each said chamber, pneumatic means for pneumatically moving said pistons sequentially outwardly from said retracted position to said expelled position at a dispensing station, said pneumatic means including a shoe having an internal passageway for connection to a pressurized source of air and a cavity in communication with said passageway and in aligned relation with at least one of said pistons, and means for returning each piston to said retracted position down-stream of said dispensing station.

2. A rotatable wheel as set forth in claim 1 wherein each piston has an integral stop thereon for limiting outward movement of said piston to said expelled position.

3. A rotatable granular dispensing wheel comprising an outer ring having a plurality of circumferentially disposed radially directed chambers for receiving granular filter material at a filling station;

a plurality of pistons, each said piston being slidably mounted in a respective chamber and having a stop thereon for limiting radial outward and inward movement of a piston relative to a respective chamber;

pneumatic means for pneumatically moving said pistons sequentially and radially in an outward direction at a dispensing station to eject granular material from each respective chamber in said dispensing station; and a second pneumatic means between said dispensing station and said filling station for moving said pistons sequentially and radially in an inward direction to a retracted position.

4. A dispensing wheel as set forth in claim 3 wherein said second pneumatic means includes a shoe having a passageway for a flow of pressurized air aligned with a plurality of said chambers and a pair of flanges disposed in overlapping relation with said outer ring.

5. A dispensing wheel as set forth in claim 3 which further comprises a cam for retaining said pistons in said retracted position, said cam extending to a point beyond said filling station.

6. A rotatable granular dispensing wheel comprising an outer ring having a plurality of circumferentially disposed radially directed chambers for receiving granular filter material at a filling station;

a plurality of pistons, each said piston being slidably mounted in a respective chamber and having a stop thereon for limiting radial outward and inward movement of a piston relative to a respective chamber;

pneumatic means for pneumatically moving said pistons sequentially and radially in an outward direction at a dispensing station to eject granular material from each respective chamber in said dispensing station, said pneumatic means including a shoe having an internal passageway for connection to a pressurized source of air and a peripheral cavity in communication with said passageway and in aligned relation with a plurality of said pistons in said dispensing station; and means for moving said pistons sequentially and radially in an inward direction to a retracted position.

7. A dispensing wheel as set forth in claim 4 which further comprises a guide ring concentrically within said outer ring and having radial bores for slidably guiding said pistons therein, said bores being in aligned relation with said cavity in said dispensing station.

8. A dispensing wheel as set forth in claim 6 wherein each stop is integral with a respective piston.

9. A dispensing wheel as set forth in claim 7 which further comprises means for resiliently biasing said shoe radially outwardly against said guide ring.

10. A dispensing wheel as set forth in claim 6 wherein said means for moving said pistons to said retracted position comprises a second pneumatic means between said dispensing station and said filling station.

11. A dispensing wheel as set forth in claim 10 wherein said second pneumatic means includes a second shoe having a passageway for a flow of pressurized air aligned with a plurality of said chambers and a pair of flanges disposed in overlapping relation with said outer ring.

12. A dispensing wheel as set forth in claim 10 which further comprises a cam for retaining said pistons in said retracted position, said cam extending to a point beyond said filling station.

13. A dispensing wheel as set forth in claim 4 which further comprises a shroud extending over said chambers in said outer ring from said filling station to said dispensing station, said shroud having a slightly blunted tip in said filling station to push filter material therefrom while shearing particles of filter material extending outwardly of a chamber passing under said tip.

14. A dispensing wheel comprising an outer ring having a plurality of circumferentially disposed chambers for receiving charges of material at a filling station;

a plurality of pistons, each piston being slidably mounted in a respective chamber and having a stop for limiting outward movement of a piston relative to a respective chamber;

a guide ring concentrically within said outer ring and having bores for slidably guiding said pistons therein with each stop disposed between said rings to limit inward movement of a respective piston relative to said guide ring;

pneumatic means for pneumatically moving said pistons sequentially in an outward direction at a dispensing station to eject material from each respective chamber in said dispensing station; and a second pneumatic means between said dispensing station and said filling station for pneumatically moving said pistons sequentially in an inward direction to abut a respective stop thereon against said guide ring.

15. A dispensing wheel as set forth in claim 14 wherein said first pneumatic means includes a shoe having an internal passageway for connection to a pressurized source of air and a peripheral cavity in communication with said passageway and in aligned relation with a plurality of said pistons in said dispensing station.

16. A dispensing wheel as set forth in claim 14 wherein each stop is integral with a respective piston.

17. A dispensing wheel as set forth in claim 16 wherein each piston is made of tool steel having a 54-55 Rockwell Hardness on the C-scale.

18. A dispensing wheel as set forth in claim 16 wherein each stop has a rounded fillet adjacent a respective piston and each chamber has a circumferential notch at an end for receiving a respective fillet in mating relation.

19. A dispensing wheel as set forth in claim 14 wherein said second pneumatic means includes a second shoe having a passageway for a flow of pressurized air aligned with a plurality of said chambers and a pair of flanges disposed in overlapping relation with said outer ring.

20. A dispensing wheel as set forth in claim 14 which further comprises a shroud extending over said chambers in said outer ring from said filling station to said dispensing station, said shroud having a slightly blunted tip in said filling station to push filter material therefrom while shearing particles of filter material extending outwardly of a chamber passing under said tip.

21. In combination with a filter cigarette making machine having a conveyor for conveying a continuous web of paper and a series of spaced apart filter elements on the continuous web through a granular charcoal dispensing station and a hopper of granular charcoal filter material at a filling station;

a charcoal dispensing wheel between said hopper and said dispensing station, said wheel having a plurality of circumferentially disposed and radially extending chambers for receiving charcoal from said hopper at said filling station, a plurality of pistons, each said piston being slidably mounted in a respective chamber between a retracted position at said filling station and an expelled position at said dispensing station, pneumatic means for pneumatically moving said piston into said expelled position in said dispensing station to eject charcoal from a respective chamber, said pneumatic means including a shoe having an internal passageway for connecting to a pressurized source of air and a peripheral cavity in communication with said passageway and in aligned relation with at least one of said pistons in said dispensing station.

* * * * *

UNITED STATES PATENT AND TRADEMARK OFFICE

CERTIFICATE OF CORRECTION

PATENT NO. : 4,425,107

DATED : January 10, 1984

INVENTOR(S) : Floyd V. Hall

It is certified that error appears in the above—identified patent and that said Letters Patent is hereby corrected as shown below:

In the Claims:

Claim 7 should be dependant on Claim 6.

Signed and Sealed this

*Seventeenth* Day of *April 1984*

[SEAL]

*Attest:*

GERALD J. MOSSINGHOFF

*Attesting Officer*

*Commissioner of Patents and Trademarks*